US012781414B2

(12) United States Patent
Veasey

(10) Patent No.: US 12,781,414 B2
(45) Date of Patent: Nov. 3, 2026

(54) STRUCTURAL SHIPPING BRACKET FOR A WASHING MACHINE APPLIANCE

(71) Applicant: Haier US Appliance Solutions, Inc., Wilmington, DE (US)

(72) Inventor: Rebretta Veasey, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 45 days.

(21) Appl. No.: 18/819,660

(22) Filed: Aug. 29, 2024

(65) Prior Publication Data

US 2026/0062853 A1 Mar. 5, 2026

(51) Int. Cl.

| | |
|---|---|
| ***D06F 39/00*** | (2020.01) |
| ***D06F 23/02*** | (2006.01) |
| ***D06F 23/04*** | (2006.01) |
| ***D06F 39/12*** | (2006.01) |

(52) U.S. Cl.

CPC ..... *D06F 39/001* (2013.01); *D06F 23/02* (2013.01); *D06F 23/04* (2013.01); *D06F 39/12* (2013.01)

(58) Field of Classification Search

CPC ..... D06F 39/001; D06F 23/02; D06F 23/04; D06F 39/12

USPC ..... 68/13 R

See application file for complete search history.

(56) References Cited

U.S. PATENT DOCUMENTS

| | | | |
|---|---|---|---|
| 2,823,451 | A | 2/1958 | Suhan |
| 2,901,385 | A | 8/1959 | Curtin |
| 3,184,048 | A | 5/1965 | Bjerum |
| 3,187,887 | A | 6/1965 | Charles et al. |
| 3,249,215 | A | 5/1966 | Kelly |
| 3,335,849 | A | 8/1967 | Collin |
| 3,620,365 | A | 11/1971 | Elwell |
| 3,812,959 | A | 5/1974 | Brennan |
| 3,861,525 | A | 1/1975 | Collin |
| 3,896,930 | A | 7/1975 | Collin |
| 3,912,076 | A | 10/1975 | Elwell |
| 3,913,736 | A | 10/1975 | Brennan |
| 4,240,550 | A | 12/1980 | Collin |
| 4,366,902 | A | 1/1983 | Fanson et al. |
| 4,624,117 | A | 11/1986 | Ory et al. |

(Continued)

FOREIGN PATENT DOCUMENTS

| | | |
|---|---|---|
| CN | 203530705 U | 4/2014 |
| CN | 207552724 U | 6/2018 |

(Continued)

OTHER PUBLICATIONS

EP0221612B1—machine translation (Year: 1992).*

*Primary Examiner* — Tinsae B Ayalew

(74) *Attorney, Agent, or Firm* — Dority & Manning, P.A.

(57) ABSTRACT

A washing machine appliance may include a cabinet. The cabinet may include a rear panel. The rear panel may include an outer face and an inner face. The washing machine appliance may include a sub washer provided within the cabinet. The washing machine appliance may include a structural shipping bracket. The structural bracket may include a main body and a mount. The main body may define an opening therethrough. The mount may be extended from the main body. The structural shipping bracket may be affixed to the inner face of the rear panel at the mount. The washing machine appliance may include a shipping bolt removably disposed within the opening of the structural shipping bracket.

17 Claims, 10 Drawing Sheets

(56) References Cited

U.S. PATENT DOCUMENTS

| | | | |
|---|---|---|---|
| 4,700,832 | A | 10/1987 | Champ |
| 4,819,459 | A | 4/1989 | Keith |
| 4,832,190 | A | 5/1989 | Favreau |
| 5,056,341 | A | 10/1991 | Mori et al. |
| 5,190,089 | A | 3/1993 | Jackson |
| 5,533,367 | A | 7/1996 | Lybarger et al. |
| 7,014,160 | B2 | 3/2006 | Muyskens |
| 7,258,319 | B2 | 8/2007 | Johanson et al. |
| 7,441,420 | B2 | 10/2008 | Kim et al. |
| 7,900,485 | B2 | 3/2011 | Lee et al. |
| 7,921,679 | B2 | 4/2011 | Jo |
| 7,980,103 | B2 | 7/2011 | Kim |
| 8,118,379 | B2 | 2/2012 | Hong et al. |
| 8,317,150 | B2 | 11/2012 | Baechle |
| 8,807,151 | B2 | 8/2014 | Büsing et al. |
| 8,955,812 | B2 | 2/2015 | Marrow |
| 9,279,208 | B2 | 3/2016 | Sul et al. |
| 9,540,158 | B1 | 1/2017 | Fox |
| 9,580,855 | B2 | 2/2017 | Kim |
| 10,316,452 | B2 | 6/2019 | Lee |
| 10,584,437 | B2 | 3/2020 | Lee et al. |
| 10,597,810 | B2 | 3/2020 | Nam et al. |
| 10,787,763 | B2 | 9/2020 | Zhang et al. |
| 10,837,136 | B2 | 11/2020 | Rineer et al. |
| 11,066,773 | B2 | 7/2021 | Lee |
| 11,198,967 | B2 | 12/2021 | Millán et al. |
| 11,352,732 | B2 | 6/2022 | Chun et al. |
| 11,780,663 | B1 | 10/2023 | Moore |
| 11,795,602 | B1 | 10/2023 | Lee et al. |
| 11,859,331 | B2 | 1/2024 | Chun et al. |
| 11,885,061 | B2 | 1/2024 | Anburaj et al. |
| 2004/0118167 | A1 | 6/2004 | Kim et al. |
| 2004/0237602 | A1 | 12/2004 | Lappoehn et al. |
| 2005/0103964 | A1 | 5/2005 | Baechle |
| 2006/0231726 | A1 | 10/2006 | Kwon et al. |
| 2007/0000289 | A1 | 1/2007 | Aring et al. |
| 2007/0000290 | A1 | 1/2007 | Fechtel et al. |
| 2008/0168803 | A1 | 7/2008 | Muyskens |
| 2008/0178639 | A1 | 7/2008 | Griswold |
| 2009/0074535 | A1 | 3/2009 | Roberts et al. |
| 2009/0212673 | A1 | 8/2009 | Park et al. |
| 2011/0048578 | A1 | 3/2011 | Trebilcock et al. |
| 2011/0095157 | A1 | 4/2011 | Krieg |
| 2011/0121698 | A1 | 5/2011 | Kahraman et al. |
| 2011/0167877 | A1 | 7/2011 | Reason et al. |
| 2011/0233086 | A1 | 9/2011 | Rockwell et al. |
| 2012/0031796 | A1 | 2/2012 | Perini et al. |
| 2012/0104913 | A1 | 5/2012 | Bak et al. |
| 2013/0014546 | A1 | 1/2013 | Kobayashi et al. |
| 2015/0337479 | A1 | 11/2015 | Senn et al. |
| 2019/0382938 | A1 | 12/2019 | Lee |
| 2020/0024791 | A1 | 1/2020 | Tobbe et al. |
| 2020/0309318 | A1 | 10/2020 | Gabbard |
| 2021/0079948 | A1 | 3/2021 | Xie et al. |
| 2021/0139230 | A1 | 5/2021 | Bischoff et al. |
| 2021/0214879 | A1 | 7/2021 | Lee et al. |
| 2023/0287619 | A1 | 9/2023 | Shinde et al. |
| 2023/0416968 | A1 | 12/2023 | Moore |
| 2023/0416969 | A1 | 12/2023 | Bhogulkar et al. |

FOREIGN PATENT DOCUMENTS

| | | | |
|---|---|---|---|
| CN | 106283517 | B | 5/2020 |
| CN | 107604600 | B | 7/2021 |
| EP | 0221612 | B1 | 1/1992 |
| WO | WO2018095206 | A1 | 5/2018 |

* cited by examiner

STRUCTURAL SHIPPING BRACKET FOR A WASHING MACHINE APPLIANCE

FIELD OF THE DISCLOSURE

The present subject matter relates generally to a washing machine appliance, and more particularly to structural features for a washing machine appliance.

BACKGROUND OF THE DISCLOSURE

Washing machine appliances generally include a wash tub housed within a cabinet. A wash basket is rotatably mounted within the wash tub and defines a wash chamber for receipt of articles for washing during a wash cycle. During the wash cycle, the wash basket rotates and agitates articles or wash fluid to wash the articles. The wash tub may move or vibrate within the cabinet during the wash cycle. One or more suspension devices of the washing machine appliance may suspend the wash tub within the cabinet and allow some movement relative to the cabinet during operation. The suspension devices generally allow the tub to move relative to the cabinet during operation of the washing machine appliance.

Notably, vibrations that may be experienced during the transportation of the washing machine appliance may overwhelm the suspension devices, resulting in premature wear or damage to one or more components of the appliance. Accordingly, shipping bolts and spacers are commonly used to secure the tub to the cabinet to make the washer rigid and to ensure the safe handling of the washing machine appliance during shipping or other transport. After the washing machine appliance is installed, the shipping bolts and spacers should be removed prior to operating the machine. However, sometimes the shipping bolts and spacers are inadvertently left in the washer at the time of installation. If these bolts and spacers are not removed, the suspensions of the wash tub will not be activated and there may be unsuitably high levels of noise and vibration during operation of the appliance. In addition, existing cabinet walls are required to be relatively thick to support existing shipping bolts and spacers, for instance, to withstand forces that may be applied during shipping. Cabinets that include relatively thick walls or panels can be costly to manufacture. These issues result in customer dissatisfaction, damage to the appliance or surrounding property, additional service visits, or additional costs (e.g., production costs or maintenance costs).

Accordingly, features for a washing machine appliance that obviate one or more of the above mentioned drawbacks would be beneficial.

BRIEF DESCRIPTION OF THE DISCLOSURE

Aspects and advantages of the invention will be set forth in part in the following description, or may be obvious from the description, or may be learned through practice of the invention.

In one exemplary aspect of the present disclosure, a washing machine appliance is provided. The washing machine appliance may include a cabinet. The cabinet may include a rear panel. The rear panel may include an outer face and an inner face. The washing machine appliance may include a sub washer provided within the cabinet. The washing machine appliance may include a structural shipping bracket. The structural bracket may include a main body and a mount. The main body may define an opening therethrough. The mount may be extended from the main body. The structural shipping bracket may be affixed to the inner face of the rear panel at the mount. The washing machine appliance may include a shipping bolt removably disposed within the opening of the structural shipping bracket.

In another exemplary aspect of the present disclosure, a washing machine appliance is provided. The washing machine appliance may define a vertical direction, a lateral direction, and a transverse direction. The washing machine appliance may include a cabinet. The cabinet may include a rear panel, a front panel, a first side panel, and a second side panel. The front panel and the rear panel may be spaced apart along the transverse direction. The first side panel and the second side panel may be spaced apart along the lateral direction. The rear panel may include an outer face and an inner face. The outer face and the inner face may be spaced apart along the transverse direction. The washing machine appliance may include a sub washer provided within the cabinet. The sub washer may include at least a wash tub, a wash basket, and a motor. The washing machine appliance may include a structural shipping bracket. The structural shipping bracket may include a main body, a first mount, and a second mount. The main body may extend between a first end and a second end along the lateral direction. The main body may define a first opening and a second opening therethrough. The first mount may be extended from the main body at the first end of the main body. The second mount may be extended from the main body at the second end of the main body. The structural shipping bracket my be permanently affixed to the inner face of the rear panel at the first mount and the second mount. The washing machine appliance may include a shipping spacer assembly that may be removably disposed within the first opening and the second opening of the structural shipping bracket.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
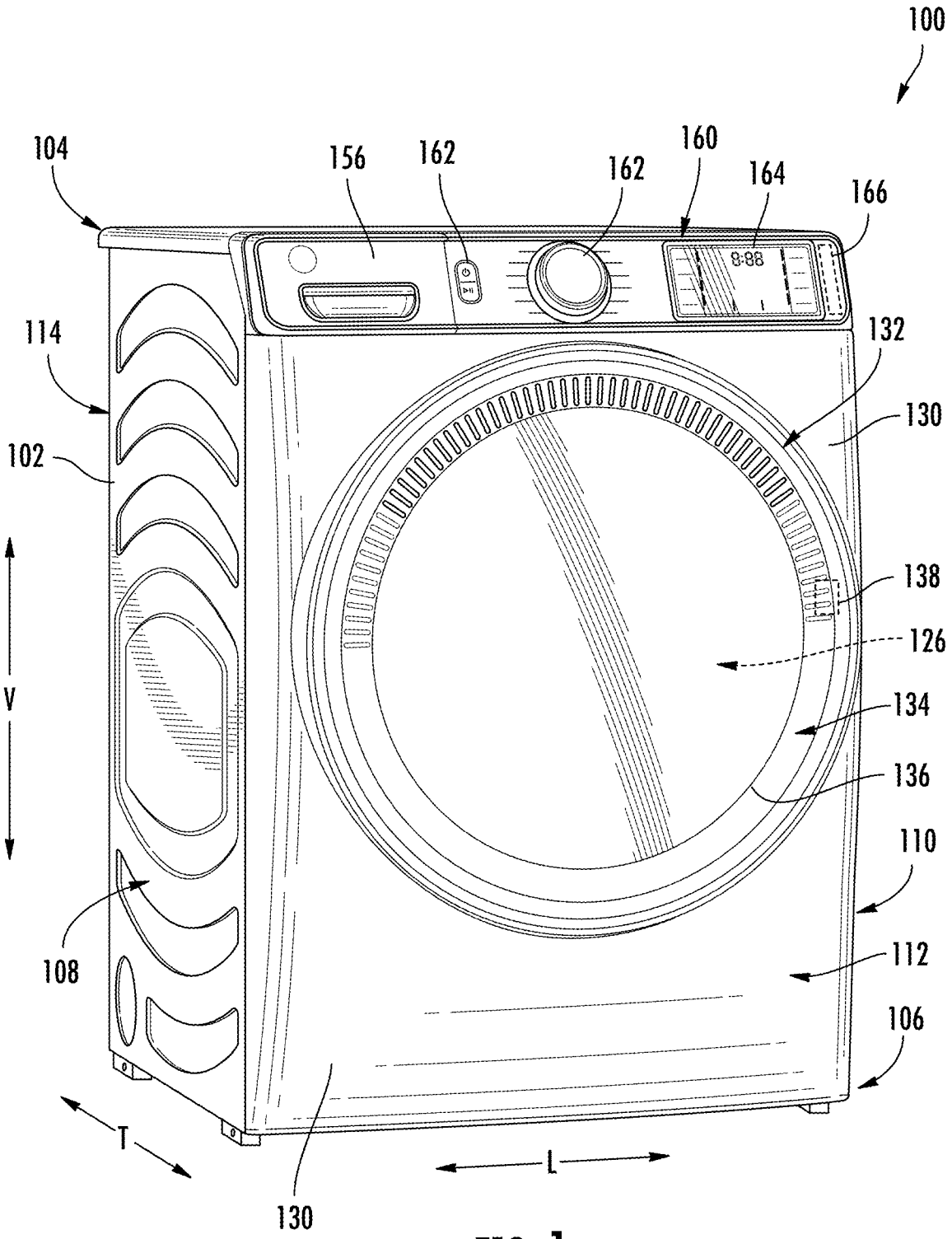
FIG. 1 provides a perspective view of a front load washing machine appliance according to one or more exemplary embodiments of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations.

Except as explicitly indicated otherwise, recitation of a singular processing element (e.g., "a controller," "a processor," "a microprocessor," etc.) is understood to include more than one processing element. In other words, "a processing element" is generally understood as "one or more processing element." Furthermore, barring a specific statement to the contrary, any steps or functions recited as being performed by "the processing element" or "said processing element" are generally understood to be capable of being performed by "any one of the one or more processing elements." Thus, a first step or function performed by "the processing element" may be performed by "any one of the one or more processing elements," and a second step or function performed by "the processing element" may be performed by "any one of the one or more processing elements and not necessarily by the same one of the one or more processing elements by which the first step or function is performed." Moreover, it is understood that recitation of "the processing element" or "said processing element" performing a plurality of steps or functions does not require that at least one discrete processing element be capable of performing each one of the plurality of steps or functions.

Embodiments of the present subject matter provide a structural shipping bracket. The structural shipping bracket may be disposed within a cabinet of the washing machine appliance. The structural shipping bracket provides support for one or more shipping bolts that secure the washing machine during transport. Notably, the structural shipping bracket can be relatively thick (e.g., when compared to existing shipping features for washing machine appliance). Advantageously, the increased thickness of the structural shipping bracket may improve overall strength and vibration resistance of the washing machine appliance, for instance, during operation of the washing machine appliance or during shipping of the washing machine appliance. Moreover, the structural shipping bracket may allow the walls (e.g., panels) of the cabinet to be thinner (e.g., approximately twenty-five percent thinner when compared to existing cabinet walls). In this regard, the performance and integrity of the washing machine appliance may be increased while production cost of the washing machine appliance may be decreased Moreover, the structural shipping bracket can be affixed (e.g., permanently) to one or more inner faces or walls of the cabinet to brace and provide rigidity to the walls (e.g., panels) of the cabinet. In this regard, the structural shipping bracket can be capable of handling stresses (e.g., vibration, normal forces, or any other suitable stress or force experienced during movement) that the cabinet may experience, for instance, during normal operation, during shipping and handling, or the like. Advantageously, when compared to existing shipping features (e.g., that may be removable and disposable), the structural shipping bracket can eliminate or reduce additional packing materials (e.g., dunnage) that is commonly removed from the washing machine appliance and disposed of after installation of the washing machine appliance.

Figure 2:
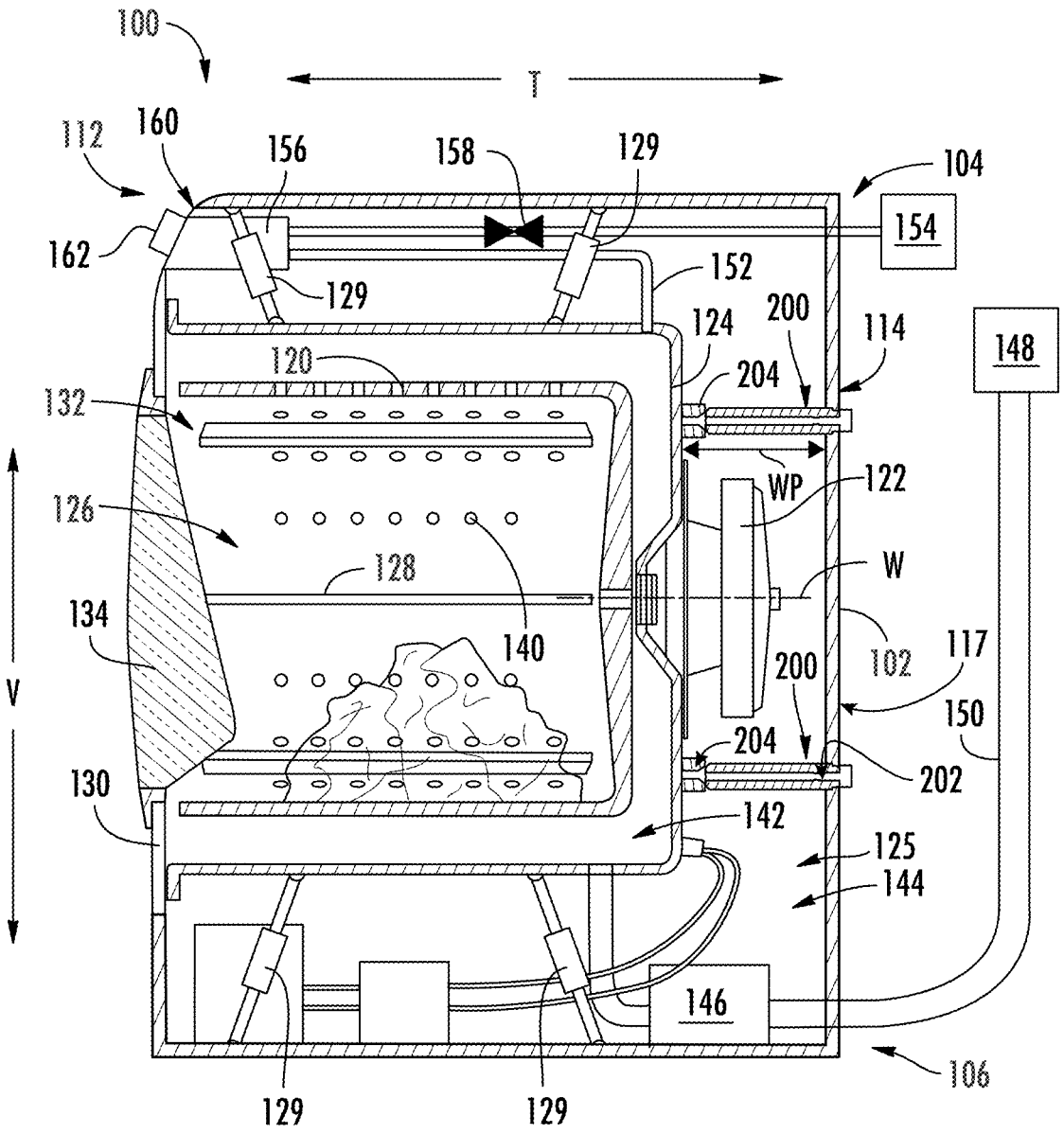
FIG. 2 provides a side cross section view of the exemplary washing machine appliance of FIG. 1.

Referring now to the figures, an exemplary laundry appliance that may be used to implement aspects of the present subject matter will be described. Specifically, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined.

According to exemplary embodiments, washing machine appliance 100 includes a cabinet 102 that is generally configured for containing or supporting various components of washing machine appliance 100 and which may also define one or more internal chambers or compartments of washing machine appliance 100. In this regard, as used herein, the terms "cabinet," "housing," and the like are generally intended to refer to an outer frame or support structure for washing machine appliance 100, e.g., including any suitable number, type, and configuration of support structures formed from any suitable materials, such as a system of elongated support members, a plurality of interconnected panels, or some combination thereof. It should be appreciated that cabinet 102 does not necessarily require an enclosure and may simply include open structure supporting various elements of washing machine appliance 100. By contrast, cabinet 102 may enclose some or all portions of an interior of cabinet 102. It should be appreciated that cabinet 102 may have any suitable size, shape, and configuration while remaining within the scope of the present subject matter.

As illustrated, cabinet 102 generally extends between a top 104 and a bottom 106 along the vertical direction V, between a first side panel 108 (e.g., the left side when viewed from the front as in FIG. 1) and a second side panel 110 (e.g., the right side when viewed from the front as in FIG. 1) along the lateral direction L, and between a front 112 and a rear panel 114 along the transverse direction T. In general, terms such as "left," "right," "front," "rear," "top," or "bottom" are used with reference to the perspective of a user accessing washing machine appliance 100.

Referring to FIG. 2, a wash basket 120 is rotatably mounted within cabinet 102 such that it is rotatable about an axis of rotation W. A motor 122, e.g., such as a pancake motor, is in mechanical communication with wash basket 120 to selectively rotate wash basket 120 (e.g., during an agitation or a rinse cycle of washing machine appliance 100). Wash basket 120 is received within a wash tub 124 and defines a wash chamber 126 that is configured for receipt of articles for washing. The wash tub 124 holds wash and rinse fluids for agitation in wash basket 120 within wash tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Wash basket 120 may define one or more agitator features that extend into wash chamber 126 to assist in agitation and cleaning articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

According to exemplary embodiments, wash tub 124 may be generally suspended within cabinet 102 by one or more suspension assemblies 129, e.g., as shown for example in FIG. 2. In this regard, wash tub 124, wash basket 120, motor 122, one or more suspension assemblies 129, and other components of washing machine appliance 100 may be referred to generally herein as a sub washer 125. In order to reduce the transmission of vibrations and other forces from the sub washer 125 to the cabinet 102 during operation of washing machine appliance 100, wash tub 124 may be generally isolated from cabinet 102 by suspension assemblies 129. This may be desirable to prevent undesirable noise, vibrations, "walking" of the appliance, etc. It should be appreciated that suspension assemblies 129 may generally include any suitable number and combination of springs, dampers, or other energy absorbing mechanisms to reduce the transmission of forces between the sub washer 125 and cabinet 102. Although exemplary suspension assemblies 129 are illustrated herein, it should be appreciated that the number, type, and configuration of suspension assemblies 129 may vary while remaining within the scope of the present subject matter.

Referring generally to FIGS. 1 and 2, cabinet 102 also includes a front panel 130 which defines an opening 132 that permits user access to wash basket 120 of wash tub 124. More specifically, washing machine appliance 100 includes a door 134 that is positioned over opening 132 and is rotatably mounted to front panel 130. In this manner, door 134 permits selective access to opening 132 by being movable between an open position (not shown) facilitating access to a wash tub 124 and a closed position (e.g., FIG. 1) prohibiting access to wash tub 124.

A window 136 in door 134 permits viewing of wash basket 120 when door 134 is in the closed position, e.g., during operation of washing machine appliance 100. Door 134 also includes a handle (not shown) that, e.g., a user may pull when opening and closing door 134. Further, although door 134 is illustrated as mounted to front panel 130, it should be appreciated that door 134 may be mounted to another side of cabinet 102 or any other suitable support according to alternative embodiments. Washing machine appliance 100 may further include a latch assembly 138 (e.g., FIG. 1) that is mounted to cabinet 102 or door 134 for selectively locking door 134 in the closed position or confirming that the door 134 is in the closed position. Latch assembly 138 may be desirable, for example, to ensure only secured access to wash chamber 126 or to otherwise ensure and verify that door 134 is closed during certain operating cycles or events.

Referring again to FIG. 2, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of and generally collects wash fluid during operation of washing machine appliance 100. For example, during operation of washing machine appliance 100, wash fluid may be urged by gravity from basket 120 to sump 142 through plurality of perforations 140.

A drain pump assembly 144 is located beneath wash tub 124 and is in fluid communication with sump 142 for periodically discharging soiled wash fluid from washing machine appliance 100. Drain pump assembly 144 may generally include a drain pump 146 which is in fluid communication with sump 142 and with an external drain 148 through a drain hose 150. During a drain cycle, drain pump 146 urges a flow of wash fluid from sump 142, through drain hose 150, and to external drain 148. More specifically, drain pump 146 includes a motor (not shown) which is energized during a drain cycle such that drain pump 146 draws wash fluid from sump 142 and urges it through drain hose 150 to external drain 148.

Washing machine appliance 100 may further include a wash fluid dispenser that is generally configured for dispensing a flow of water, wash fluid, etc. into wash tub 124. For example, a spout 152 is configured for directing a flow of fluid into wash tub 124. For example, spout 152 may be in fluid communication with a water supply 154 (FIG. 2) in order to direct fluid (e.g., clean water or wash fluid) into wash tub 124. Spout 152 may also be in fluid communication with the sump 142. For example, pump assembly 144 may direct wash fluid disposed in sump 142 to spout 152 in order to circulate wash fluid in wash tub 124.

As illustrated in FIG. 2, a detergent drawer 156 is slidably mounted within front panel 130. Detergent drawer 156 receives a wash additive (e.g., detergent, fabric softener, bleach, or any other suitable liquid or powder) and directs the fluid additive to wash tub 124 during operation of washing machine appliance 100. According to the illustrated embodiment, detergent drawer 156 may also be fluidly coupled to spout 152 to facilitate the complete and accurate dispensing of wash additive. It should be appreciated that according to alternative embodiments, these wash additives could be dispensed automatically via a bulk dispensing unit (not shown). Other systems and methods for providing wash additives are possible and within the scope of the present subject matter.

In addition, a water supply valve 158 may provide a flow of water from a water supply source (such as a municipal water supply 154) into detergent dispenser 156 and into wash tub 124. In this manner, water supply valve 158 may generally be operable to supply water into detergent dispenser 156 to generate a wash fluid, e.g., for use in a wash cycle, or a flow of fresh water, e.g., for a rinse cycle. It should be appreciated that water supply valve 158 may be positioned at any other suitable location within cabinet 102. In addition, although water supply valve 158 is described herein as regulating the flow of "wash fluid," it should be appreciated that this term includes, water, detergent, other additives, or some mixture thereof.

During operation of washing machine appliance 100, laundry items are loaded into wash basket 120 through opening 132, and washing operation is initiated through operator manipulation of one or more input selectors or using a remote device (see below). Wash tub 124 is filled with water, detergent, or other fluid additives, e.g., via spout 152 or detergent drawer 156. One or more valves (e.g., water supply valve 158) can be controlled by washing machine appliance 100 to provide for filling wash basket 120 to the appropriate level for the amount of articles being washed or rinsed. By way of example for a wash mode, once wash basket 120 is properly filled with fluid, the contents of wash basket 120 can be agitated (e.g., with ribs 128) for washing of laundry items in wash basket 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle or after the rinse cycle in order to wring wash fluid from the articles being washed. During a final spin cycle, basket 120 is rotated at relatively high speeds and drain assembly 144 may discharge wash fluid from sump 142. After articles disposed in wash basket 120 are cleaned, washed, or rinsed, the user can remove the articles from wash basket 120, e.g., by opening door 134 and reaching into wash basket 120 through opening 132.

In certain embodiments, control panel 160, with at least one input selector 162, extends from front 112. Control panel 160 and input selector 162 collectively form a user interface input for operator selection of machine cycles and features. A display 164 of control panel 160 indicates selected features, operation mode, a countdown timer, or other items of interest to appliance users regarding operation. Operation of washing machine appliance 100 may be controlled by a controller 166 connected (e.g., electrically coupled) to control panel 160 for user manipulation to select washing machine cycles and features. In response to user manipulation of control panel 160, controller 166 operates the various components of washing machine appliance 100 to execute selected machine cycles and features.

Controller 166 may include a memory (e.g., non-transitive media) and microprocessor, such as a general or special purpose microprocessor operable to execute programming instructions or micro-control code associated with a selected machine cycles and features (e.g., as part of a washing operation). The memory may represent random access memory such as DRAM, or read only memory such as ROM or FLASH. In certain embodiments, the processor executes programming instructions stored in memory. The memory may be a separate component from the processor or may be included onboard within the processor. Alternatively, controller 166 may be constructed without using a microprocessor (e.g., using a combination of discrete analog or digital logic circuitry, such as switches, amplifiers, integrators, comparators, flip-flops, AND gates, and the like) to perform control functionality instead of relying upon software. Control panel 160 and other components of washing machine appliance 100 (e.g., one or more sensors, such as a pressure sensor mounted to tub 121) may be in communication with controller 166 via one or more signal lines or shared communication busses.

Figure 3:
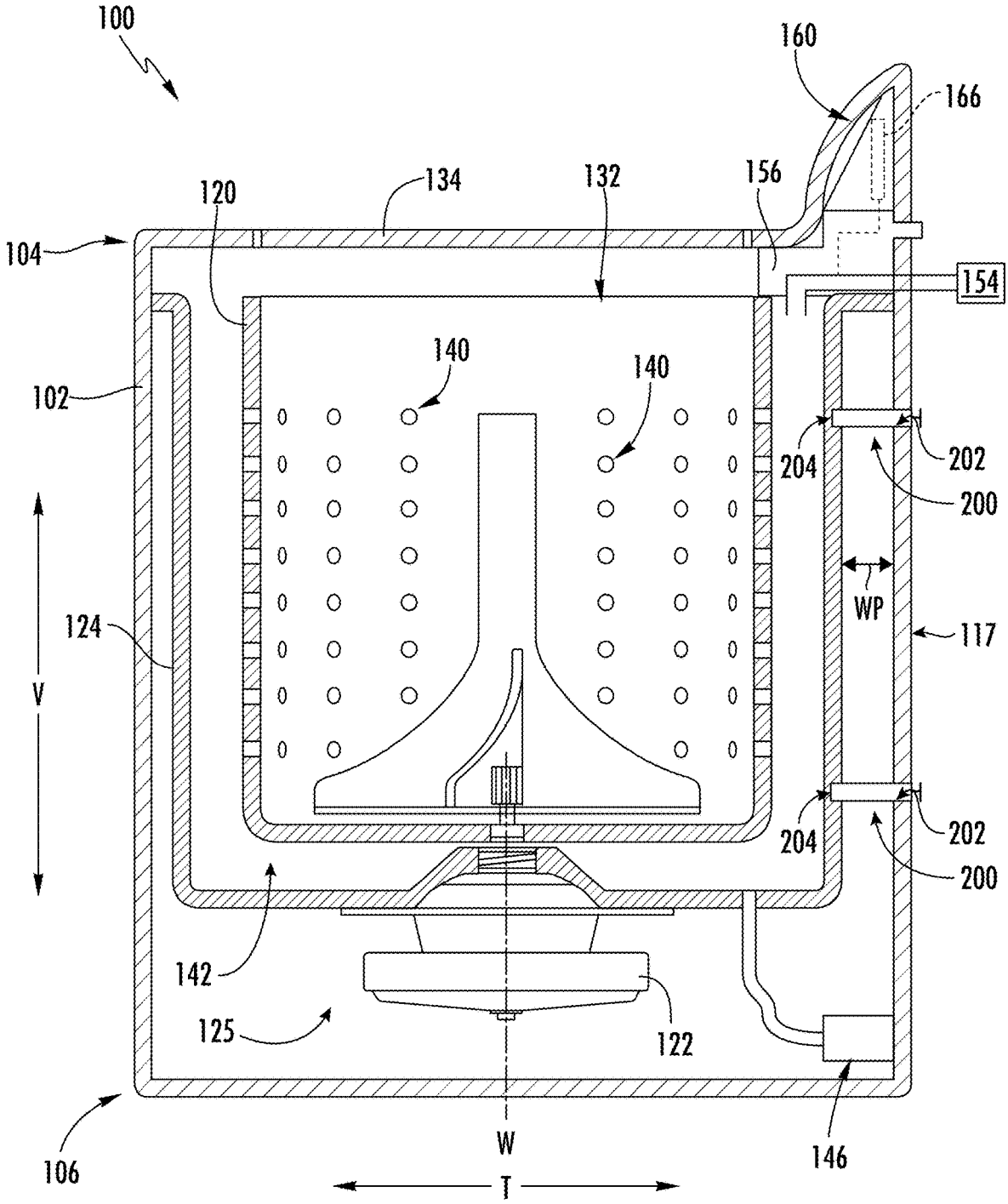
FIG. 3 provides a side cross section view of a top load washing machine appliance according to one or more exemplary embodiments of the present subject matter.

FIG. 2 depicts a side section view of washing machine appliance 100 that is a front load washing machine. FIG. 3 depicts a side section view of a washing machine appliance that is a top load washing machine. Washing machine appliance 100 is shown in FIGS. 1 and 2 as a front loading washing machine, as an example. Other embodiments of a washing machine appliance may also be used in embodiments, such as a top loading washing machine (as shown in FIG. 3), a dryer appliance, or another household appliance where stabilization during shipping may be beneficial. Generally, features of washing machine appliance 100 will be described below, with the understanding that other embodiments may include or be provided as another suitable household appliance (e.g., defining an internal chamber). In addition, it should be appreciated that like reference numerals may be used to refer to the same or similar features between the washing machine appliances 100 illustrated in FIGS. 1 through 3.

As shown in FIGS. 2 and 3, a shipping spacer assembly 200 may be attached to wash tub 124. Rear panel 114 defines a spacer hole 202 extending therethrough in transverse direction T. Wash tub 124 further defines a bolt boss 204 extending into wash tub 124. Generally, shipping spacer assembly 200 is removably attached to wash tub 124 for fixing a distance WP between wash tub 124 and cabinet 102 in an installed position. In some embodiments, shipping spacer assembly 200 attaches to wash tub 124 by entering bolt boss 204, a portion of shipping spacer assembly 200 extending between rear panel 114 and wash tub 124. In other words, a portion of shipping spacer assembly 200 extends through spacer hole 202 and into bolt boss 204. Shipping spacer assembly 200 is configured to attach to wash tub 124 by removable receipt through spacer hole 202. Advantageously, fixing distance WP between wash tub 124 and cabinet 102 may allow the wash tub 124 to be rigidly fixed during transportation. Thus, wear on the suspension system 129 due to movement during transportation may be prevented. In addition, damage to the cabinet 102 due to impacts between the sub washer 125 and the cabinet 102 (e.g., that may occur when the sub washer 125 is not properly secured) may be prevented.

Figure 4:
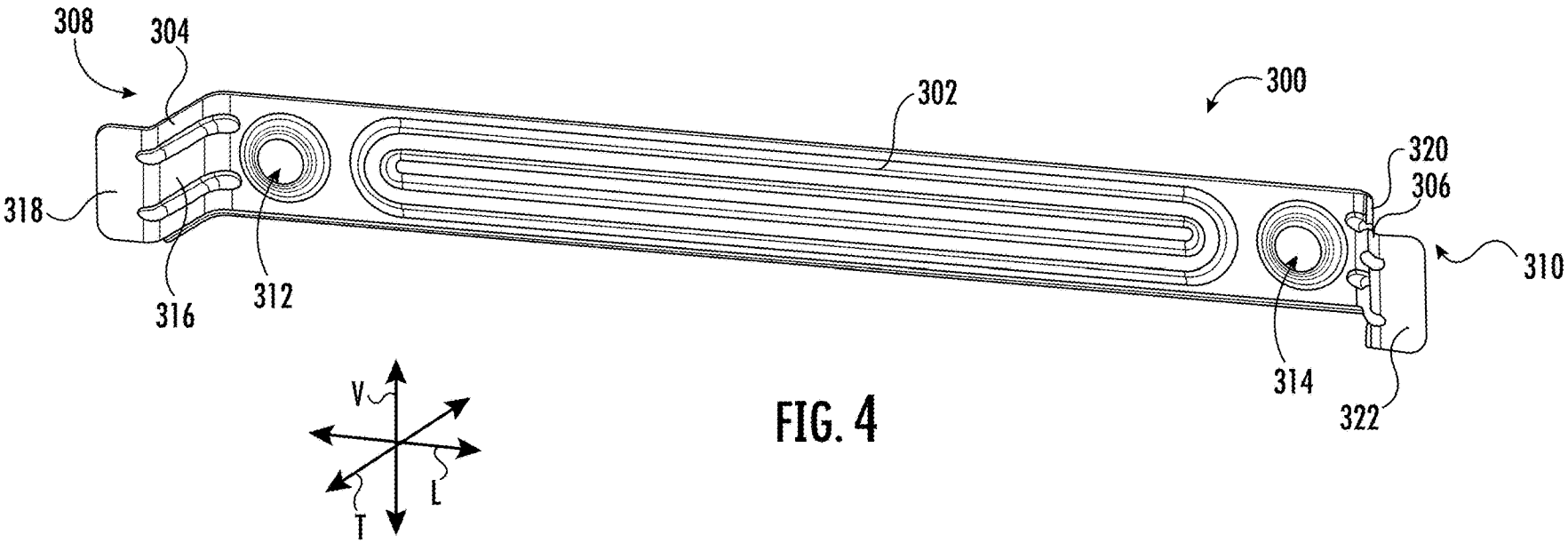
FIG. 4 provides a perspective view of a structural shipping bracket according to one or more exemplary embodiments of the present subject matter.

Referring now to FIG. 4, a perspective view of a structural shipping bracket 300 according to one or more embodiments of the present subject matter is provided. As will be appreciated in more detail below, the structural shipping bracket 300 may be affixed (e.g., permanently) to the cabinet 102 of the washing machine appliance 100. For instance, the structural shipping bracket 300 may be disposed inward (e.g., along the transverse direction T or the lateral direction L) of an inner face 103 of the cabinet 102.

The structural shipping bracket 300 may include a main body 302, a first mount 304, and a second mount 306. The main body 302 may extend between a first end 308 and a second end 310. For instance, the main body 302 may extend along the lateral direction L between the first end 308 and the second end 310. The main body 302 may define one or more openings for receiving a shipping bolt (e.g., the shipping spacer assembly 200) that may secure the wash tub 124 to the cabinet 102 for safe handling of the washing machine appliance 100 during shipping or other transport. For instance, the main body 302 may define a first opening 312 and a second opening 314 therethrough. The first opening 312 may be positioned proximate to the first end 308 of the main body 302. That is, the first opening 312 may be positioned at or within close proximity to the first end 308 of the main body 302, such as closer to the first end 308 than the second end 310 along the lateral direction L. The second opening 314 may be positioned proximate to the second end 310 of the main body 302. That is, the second opening 314 may be positioned at or within close proximity to the second end 310 of the main body 302, such as closer to the second end 310 than the first end 308 along the lateral direction L. As illustrated in FIG. 4, the first opening 312 and the second opening 314 may each define a circular cross-sectional area.

Figure 12:
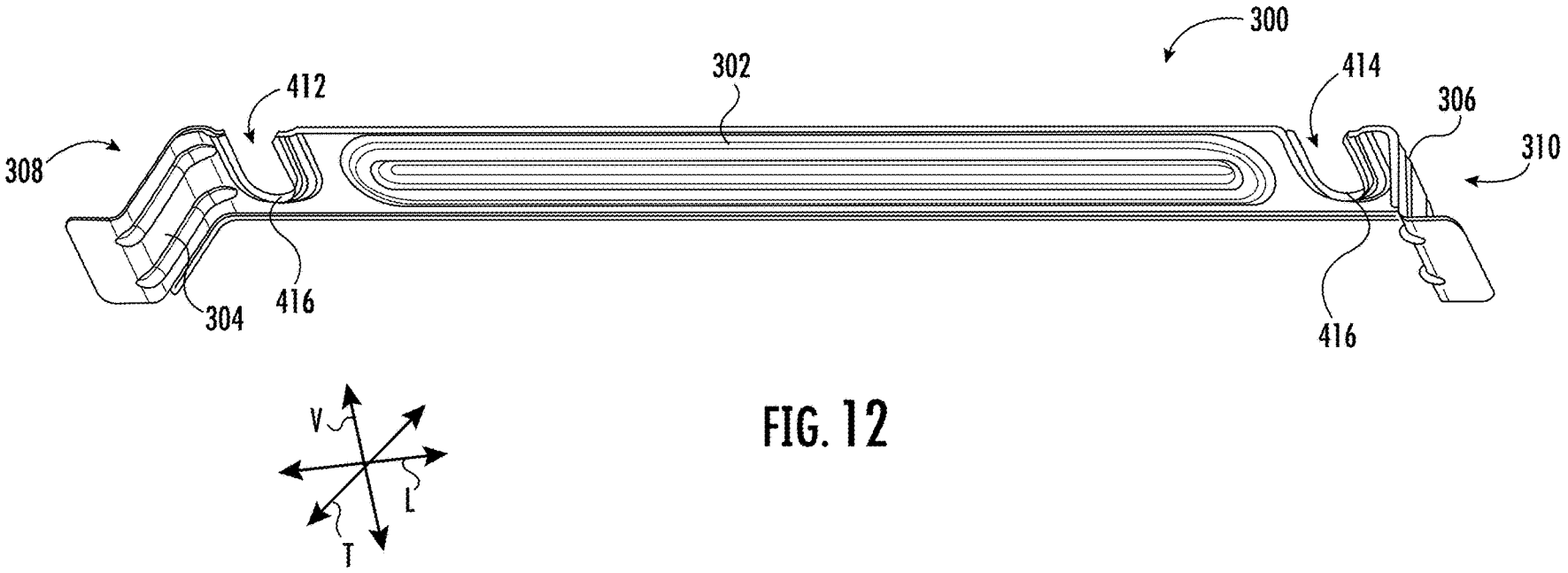
FIG. 12 provides a perspective view of the structural shipping bracket according to one or more exemplary embodiments of the present subject matter.

In additional or alternative exemplary embodiments, the openings defined through the main body 302 may be configured in any suitable manner for receiving a shipping bolt (e.g., shipping spacer assembly 200). For example, as illustrated in FIG. 12, the structural shipping bracket 300 may define slots (e.g., a first slot 412 and a second slot 414) through the main body 302 that each define a slot shaped cross-sectional area. Notably, the first slot 412 and the second slot 414 may support shipping bolts (e.g. shipping spacer assembly 200) during shipping of the washing machine appliance 100. For example, during shipping or handling of the washing machine appliance the shipping bolts (e.g., shipping spacer assembly 200) may rest on a curved or an arcuate surface 416 of the main body 302 that may define the first slot 412 or the second slot 414.

The first mount 304 may be extended from the first end 308 of the main body 302. The first mount 304 may be formed or shaped such that it may be complementary in shape to a portion of the cabinet 102 (e.g., a portion of the rear panel 114 of the cabinet 102). For example, as illustrated in FIG. 4, the first mount 304 may include a first portion 316 and a second portion 318 that are complementary in shape to a portion of the rear panel 114. The first portion 316 of the first mount 304 may extend directly from the first end 308 of the main body 302, for instance, along the transverse direction T. The second portion 318 of the first mount 304 may extend from a distal end of the first portion 316 of the first mount 304, for instance, along the lateral direction L.

The second mount 306 may be extended from the second end 310 of the main body 302. The second mount 306 may be formed or shaped such that it may be complementary in shape to a portion of the cabinet 102 (e.g., a portion of the rear panel 114 of the cabinet 102). For example, as illustrated in FIGS. 4, 5, 6, 9, and 10, the second mount 306 includes a first portion 320 and a second portion 322 that are complementary in shape to a portion of the rear panel 114. The first portion 320 of the second mount 306 may extend directly from the second end 310 of the main body 302, for instance, along the transverse direction T. The second portion 322 of the second mount 306 may extend from a distal end of the first portion 320 of the second mount 306, for instance, along the lateral direction L.

Figure 5:
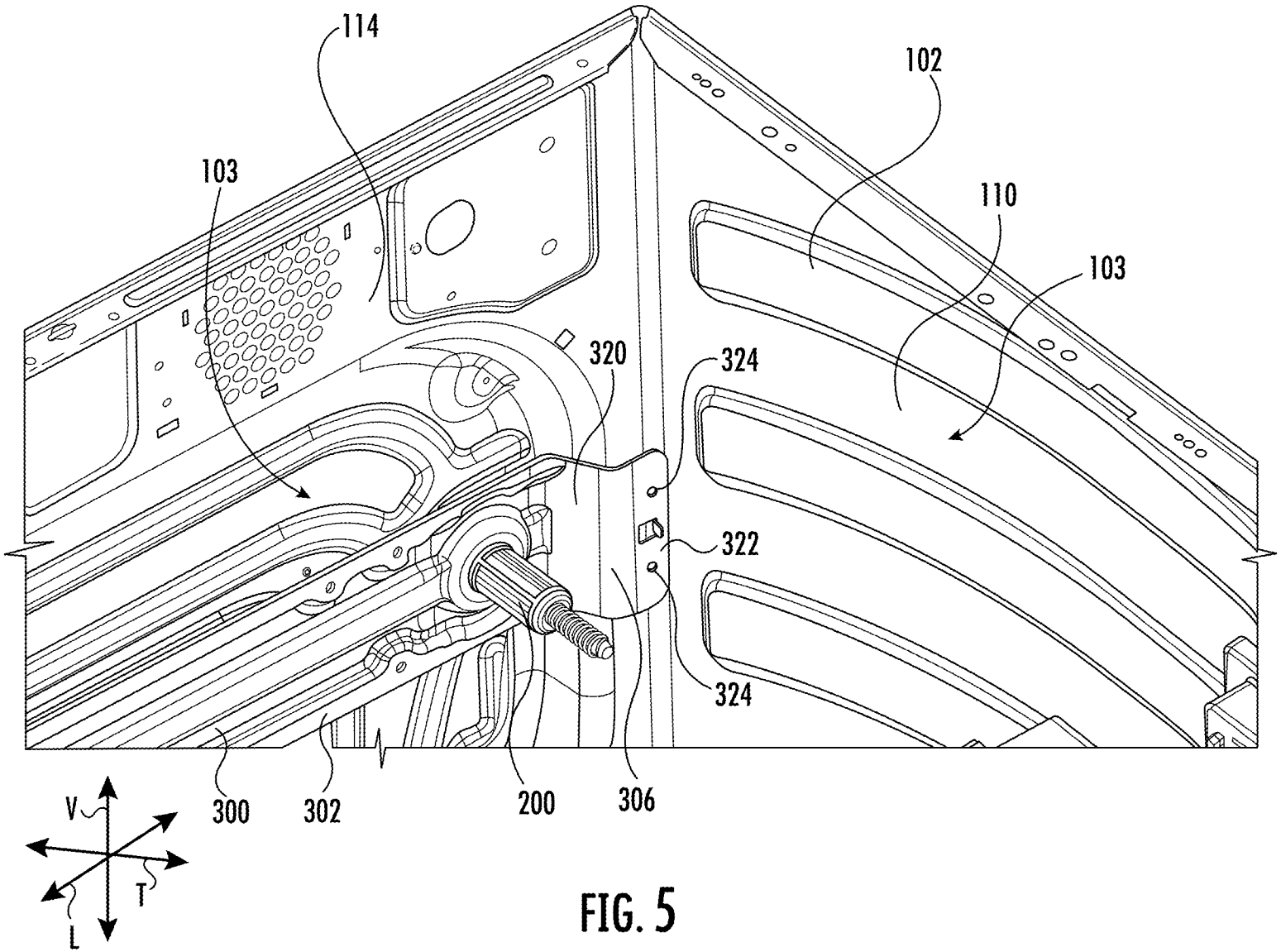
FIG. 5 provides a perspective view of the structural shipping bracket of FIG. 4 incorporated into a cabinet of a washing machine appliance according to one or more exemplary embodiments of the present subject matter.
Figure 6:
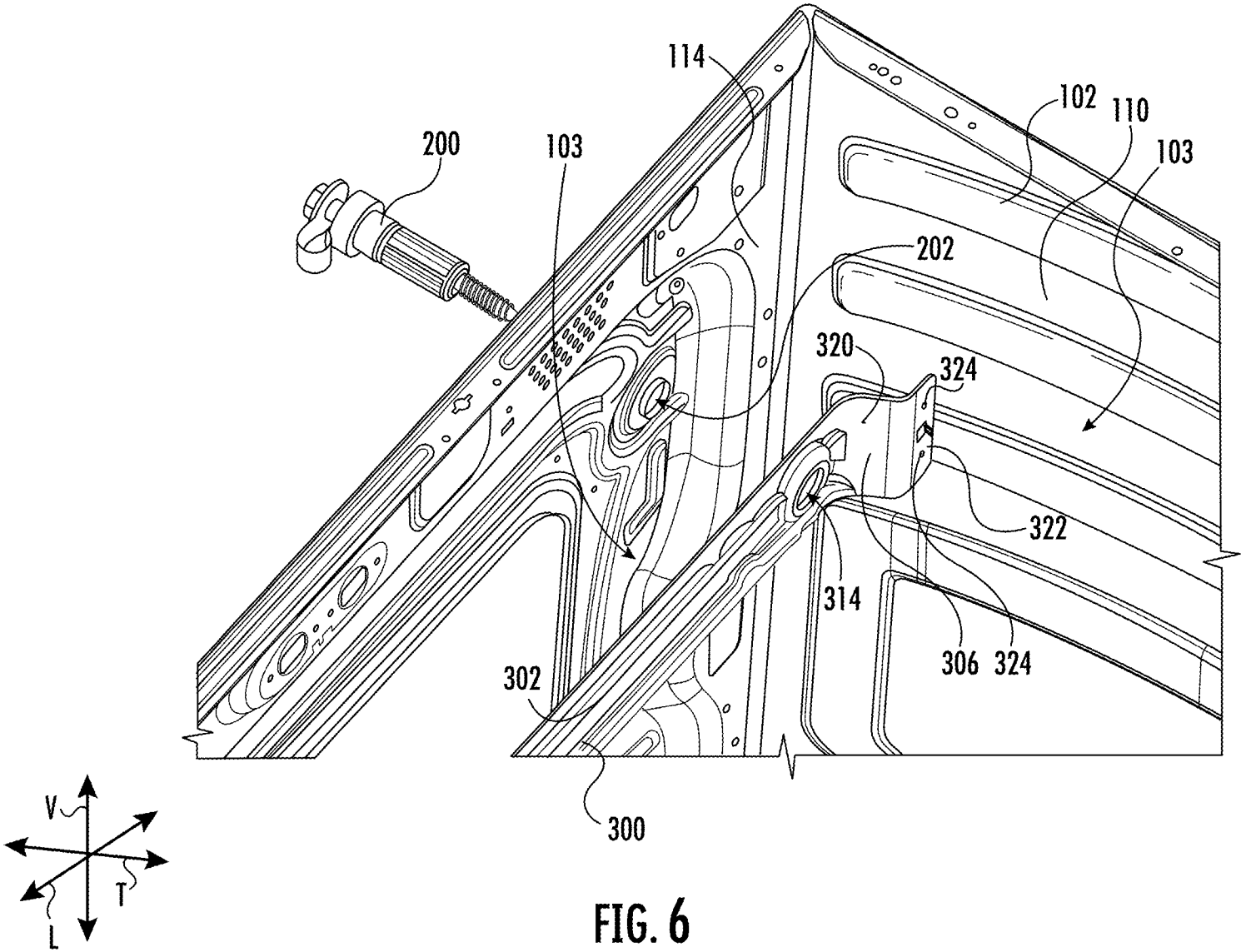
FIG. 6 provides an exploded view of the structural shipping bracket of FIG. 4 incorporated into a cabinet of a washing machine appliance according to one or more exemplary embodiments of the present subject matter.

Referring now to FIGS. 5 and 6, embodiments of the structural shipping bracket 300 being incorporated into the washing machine appliance 100 are provided. For instance, the structural shipping bracket 300 may be disposed at an inner face 103 of the cabinet 102, such that the openings (e.g., the first opening 312 and second opening 314) defined through the structural shipping bracket 300 align with corresponding spacer holes 202 defined through the rear panel 114 of the cabinet 102. In this regard, the shipping spacing assemblies 200 may be received through the cabinet 102 and the structural shipping bracket 300. As should be appreciated, the cabinet 102 illustrated in FIGS. 5 and 6, may be configured as a wrapper style cabinet. Specifically, a wrapper style cabinet may generally refer to a cabinet that includes a rear panel, a first side panel, and a second side panel that are formed from a single sheet of metal (e.g., steel, coated steel, aluminum, or any other suitable metal material). For instance, in some embodiments the cabinet 102 is formed as a wrapper style cabinet such that the rear panel 114, the first side panel 108, and the second side panel 110 are formed from a single sheet of metal material.

In some embodiments, the structural shipping bracket 300 may be permanently fastened or affixed to the cabinet 102, for instance, to brace or provide rigidity to the cabinet 102. In particular, the structural shipping bracket 300 may be permanently fastened or affixed to an inner face 103 of the rear panel 114, the first side panel 108, or the second side panel 110. As used herein an "inner face" of the rear panel 114, the first side panel 108, or the second side panel may generally refer to a face or surface of the rear panel 114, the first side panel 108, or the second side panel 110 that is inward facing (e.g., facing to or toward the sub washer 125 of the washing machine 100) along the transverse direction T or the lateral direction L.

In some embodiments, the first mount 304 and the second mount 306 of structural shipping bracket 300 are permanently fastened or affixed to the inner face 103 of the cabinet 102 via one or more permanent fastening methods (e.g., single-use fastening or affixing methods that are intended to join two materials such that they cannot be removed once installed). For example, the first mount 304 and the second mount 306 may be permanently fastened or affixed to the inner face 103 of the cabinet 102 via rivets, welding, TOX®-clinching, or the like. In some embodiments, the structural shipping bracket 300 may define preformed fastener points 324. The preformed fastener points 324 may be locating points or positions on the first mount 304 or the second mount 306 that may be used to locate the permanent fastener to the inner face 103 of the cabinet 102. For example, the preformed fastener points 324 may be holes defined through first mount 304 or the second mount 306, such as through the second portion 318 of the first mount 304 or the second portion 322 of the second mount 306. In such instances, the preformed fastener points 324 may be configured to receive permanent fasteners (e.g., rivets) that may require pilot holes.

Figure 11:
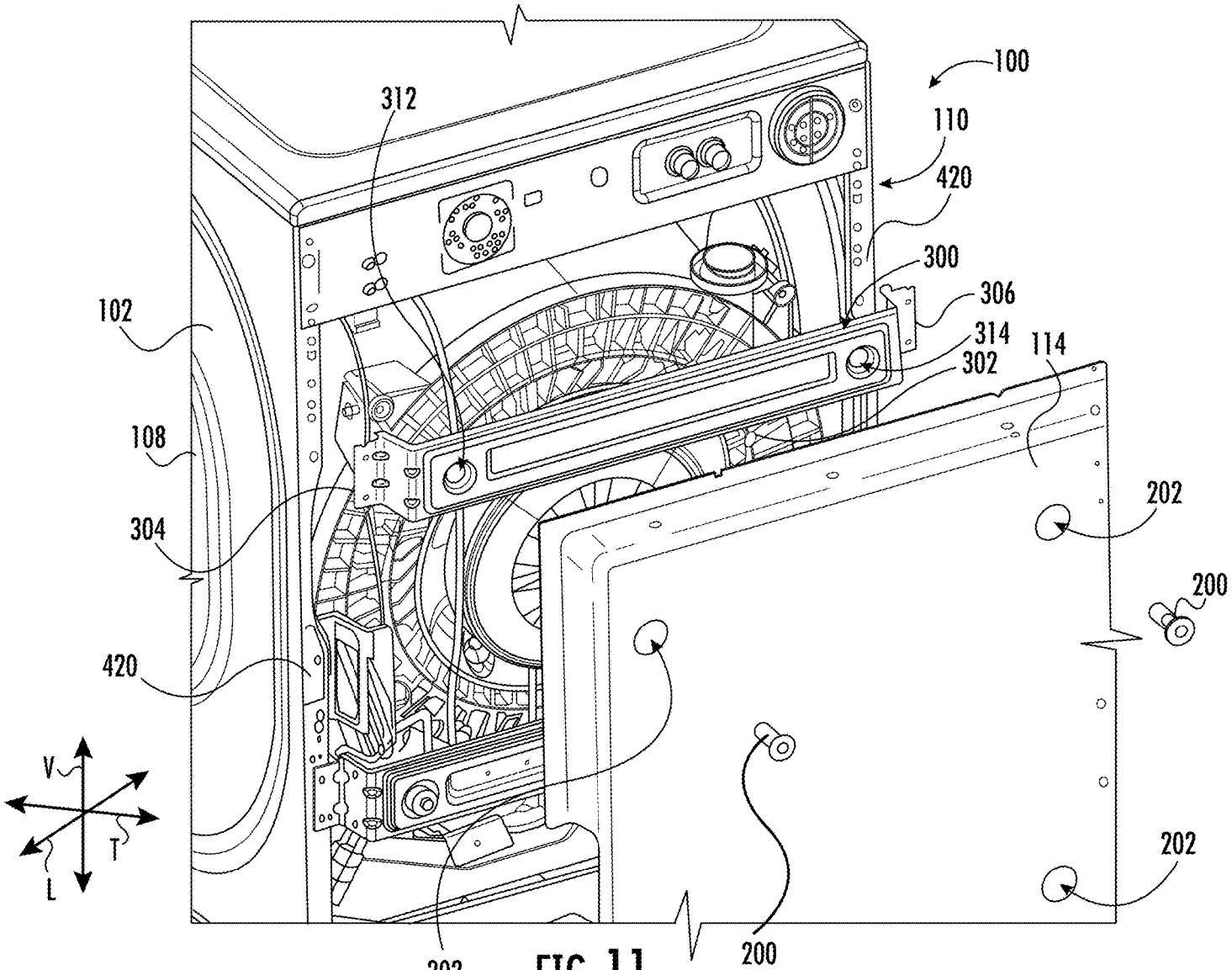
FIG. 11 provides an exploded view of a front load washing machine appliance according to one or more exemplary embodiments of the present subject matter.

In additional or alternative embodiments, the cabinet 102 may include a removable rear panel 114. For example, as illustrated in FIG. 11, the rear panel 114 may be removable for installation, servicing, or the like. In such embodiments, the structural shipping bracket 300 may be permanently fastened or affixed to the first side panel 108 and the second side panel 110 of the cabinet 102. For instance, in such embodiments, the first side panel 108 and the second side panel 110 each include lips 420 that the first mount 304 and the second mount 306 may be permanently fastened or affixed to. As should be appreciated, in such embodiments, the lips 420 of the first side panel 108 or the second side panel 110 correspond to an inner face 103 of the cabinet 102.

Only one structural shipping bracket 300 being permanently fastened or affixed to the cabinet 102 is illustrated and described for clarity and brevity only. As should be appreciated, one or more structural shipping brackets, such as two structural shipping brackets 300, may be permanently fastened or affixed to the cabinet 102 in the manner(s) described above. In such instances, the one or more structural shipping brackets 300 may be spaced vertically apart along rear panel 114 of the washing machine appliance 100.

Notably, the location of the structural shipping bracket 300 (e.g., relative to the cabinet 102) and the permanent fastening or affixing of the structural shipping bracket 300 to the cabinet 102 may advantageously allow for a reduction in a thickness of the panels (e.g., first side panel 108, second side panel 110, or the rear panel 114) of the cabinet 102, for instance, when compared to the thickness of existing cabinet panels. For instance, as the structural shipping bracket 300 is permanently fastened or affixed to the inner face 103 of the cabinet 102, the structural shipping bracket 300 may brace or provide rigidity to the cabinet 102 such that a thickness of the panels (e.g., first side panel 108, second side panel 110, or the rear panel 114) of the cabinet 102 may be reduced (e.g., when compared to existing cabinet panels or walls). For instance, the thickness of the panels (e.g., first side panel 108, second side panel 110, or the rear panel 114) of the cabinet 102 may be reduced by approximately twenty-five percent, for instance, when compared to the thickness of existing cabinet panels. For example, the structural shipping bracket 300 may advantageously allow the thickness of the panels or sides of the cabinet 102 to be reduced by approximately five to seven thousandths of an inch.

Moreover, the permanent fastening or affixing of the structural shipping bracket 300 may advantageously reduce dunnage (e.g., disposable components used in the shipping and handling) of the washing machine appliance 100. For instance, users are typically required to remove and dispose of components that are used in the shipping and handling of the washing machine appliance 100. As the structural shipping bracket 300 is permanently fastened or affixed to the cabinet 102, the structural shipping bracket 300 may reduce or eliminate dunnage of the washing machine appliance 100 (e.g., after the cabinet 102 has been installed within a user's home).

Figure 7:
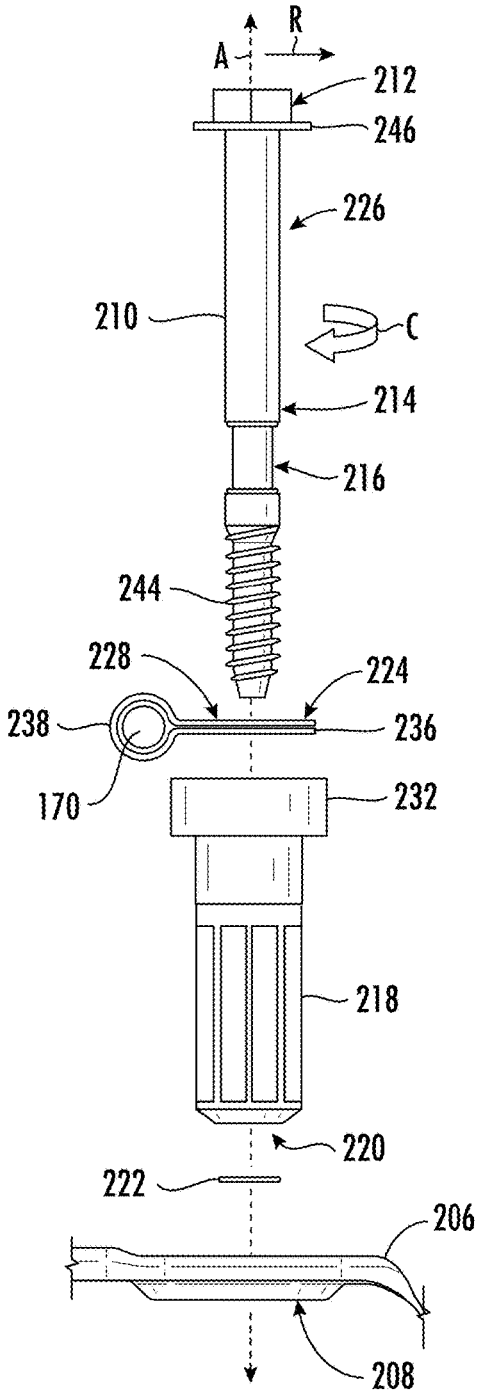
FIG. 7 provides an exploded perspective view of a shipping spacer assembly according to one or more exemplary embodiments of the present subject matter.
Figure 8:
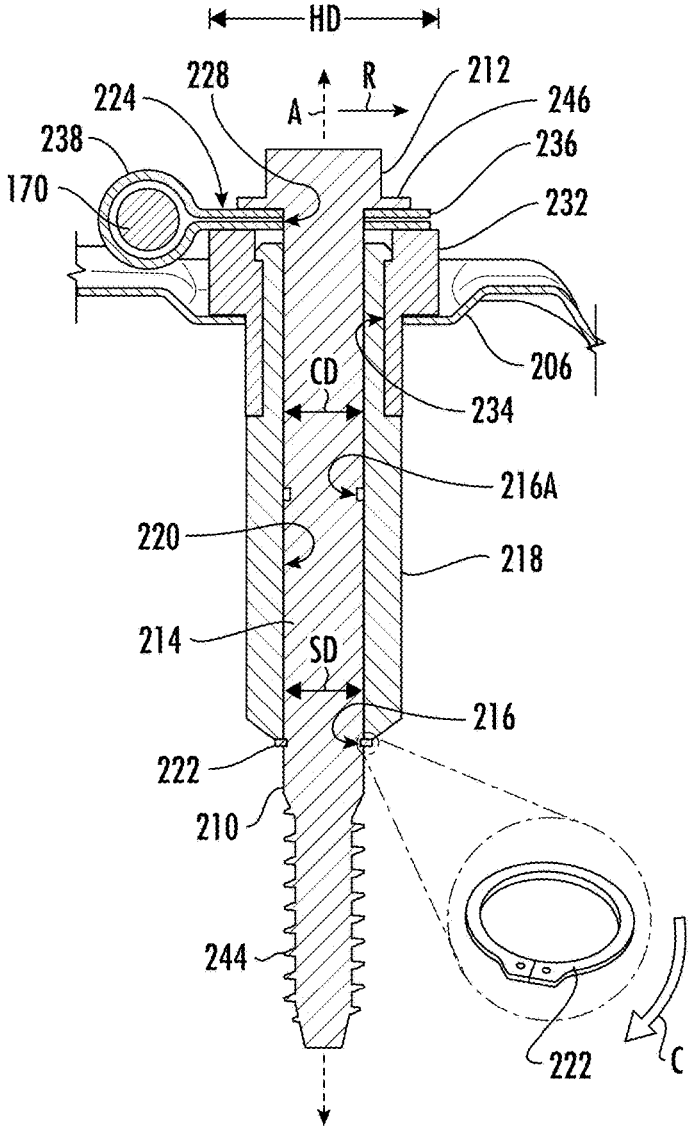
FIG. 8 provides a section view of the exemplary shipping spacer assembly of FIG. 7.
Figure 9:
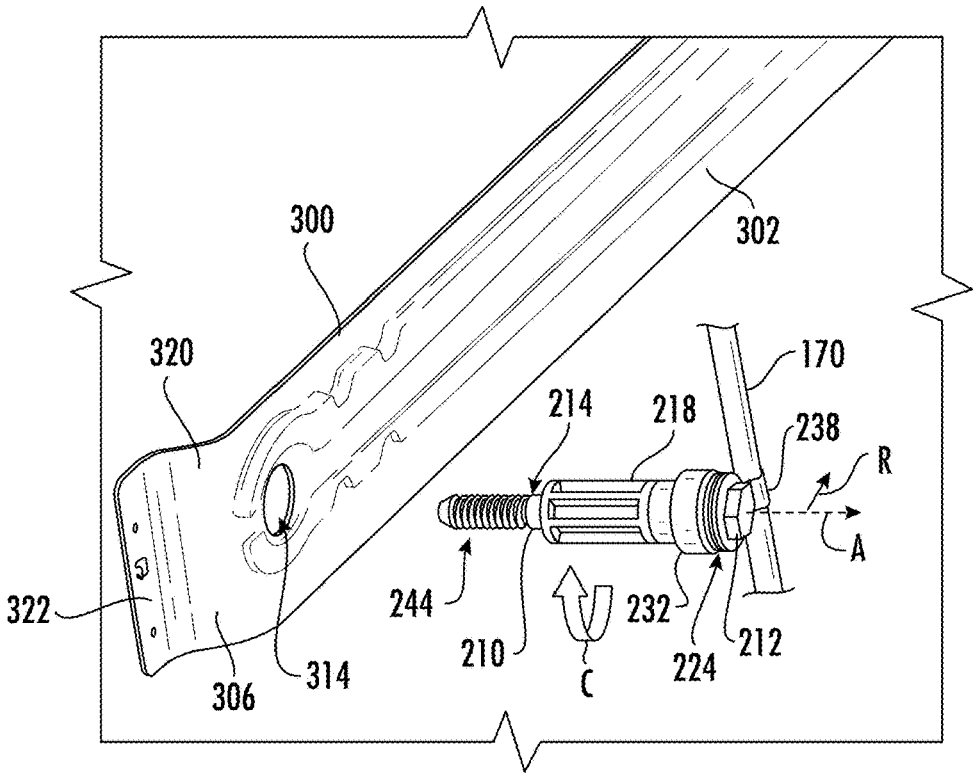
FIG. 9 provides a perspective view of an exemplary shipping spacer assembly and an exemplary structural shipping bracket according to one or more exemplary embodiments of the present subject matter.

Turning to FIGS. 7 through 10, embodiments of shipping spacer assembly 200 are depicted. As shown in FIGS. 7 and 8, shipping spacer assembly 200 defines an axial direction A, a radial direction R, and a circumferential direction C. Shipping spacer assembly 200 generally includes a bolt 210, and a feature for fixing distance WP between the wash tub 124 and cabinet 102 (e.g., a spacer 218), and a locking mechanism 222. In some embodiments, shipping spacer assembly 200 further includes a cord retention mechanism 224. Further, shipping spacer assembly 200 may include a grommet 232. Generally, elements other than bolt 210 of shipping spacer assembly 200 are removably received onto bolt 210 of shipping spacer assembly 200, as shown in FIGS. 7 and 8. Each of these features of shipping spacer assembly 200 will be described in more detail below.

Bolt 210 includes a shaft 214 extending along the axial direction A, a head 212 located at one end of shaft 214, and a threaded portion 244 located at an opposing end of shaft 214. For example, threaded portion 244 is located opposite head 212 of bolt 210 in the axial direction A. As shown, bolt 210 defines a lock-receiving feature 216 along shaft 214. Lock-receiving feature 216 may be in a position between threaded portion 244 and head 212. Bolt 210 is configured to be inserted into spacer hole 202 and attached to bolt boss 204, fixing distance WP between wash tub 124 and cabinet 102 of washing machine appliance 100.

Shaft 214 of bolt 210 generally includes a threaded portion 244. Threaded portion 244 extends in axial direction A opposite to head 212. Shaft 214 further defines the lock-receiving feature 216. In some embodiments, shaft 214 removably receives spacer 218, locking mechanism 222, cord retention mechanism 224, or grommet 232 of shipping spacer assembly 200 between head 212 and threaded portion 244. Shaft 214 may have a shaft diameter SD.

Threaded portion 244 is configured to be removably attached to wash tub 124. Threaded portion 244 removably attaches into bolt boss 204 of wash tub 124. Threaded portion 244 may be sized to fit inside bolt boss 204 or may extend from bolt boss 204 during attachment to wash tub 124. During use, threaded portion 244 is inserted through spacer hole 202 or the opening (e.g., the first opening or the second opening) of the structural shipping bracket 300 to attach shipping spacer assembly 200 to bolt boss 204 of wash tub 124. In some embodiments, bolt boss 204 removably receives threaded portion 244 of bolt 210, which removably attaches shipping spacer assembly 200 to wash tub 124.

Head 212 of bolt 210 has a head diameter HD greater than shaft diameter SD. Head 212 is configured to hold elements of shipping spacer assembly 200 along shaft 214 when shipping spacer assembly 200 is attached thereto. In some embodiments, head 212 and locking mechanism 222 retain spacer 218, grommet 232, or cord retention mechanism 224 therebetween along the shaft 214. In other words, the head 212 aids in retaining spacer 218, grommet 232, or cord retention mechanism 224 along shaft 214 of bolt 210. In some embodiments, head 212 includes a flange 246, flange 246 attaching to shaft 214 of bolt 210. Flange 246 may extend beyond spacer 218 in radial direction R.

Lock-receiving feature 216 is defined along shaft 214 of bolt 210. Lock-receiving feature 216 is configured to removably receive locking mechanism 222. In some embodiments, and as shown in FIGS. 5 and 6, lock-receiving feature 216 includes or is provided as a groove located around shaft 214 in circumferential direction. In some embodiments, and as shown in FIG. 8, lock-receiving feature 216 includes or is provided as a hole located through shaft 214 in radial direction R. Generally, lock-receiving feature 216 is configured for removable receipt of locking mechanism 222. When locking mechanism 222 is received by lock-receiving feature 216, elements of shipping spacer assembly 200 are locked onto shaft 214 of bolt 210.

In some embodiments, more than one groove (e.g., lock-receiving feature 216A) is defined along shaft 214 of bolt 210 (e.g., as shown in FIG. 8). Such may be useful, for example, to provide for differing fixed distances between wash tub 124 and cabinet 102 of washing machine appliance models. In some embodiments, groove extends in axial direction A. Such may allow for adjustment of locking mechanism 222 to allow for varying fixed distances between wash tub 124 and cabinet 102. In other words, different washing machine appliance models may have different distances between cabinet 102 (e.g., at rear panel 114) and wash tub 124 (e.g., at bolt boss 204), and adjustable positioning of locking mechanism 222 by design of lock-receiving feature 216 may allow shipping spacer assembly 200 to be useful for more than one model of washing machine appliance. Receipt of locking mechanism 222 by lock-receiving feature 216 locks grommet 232, cord retention mechanism 224, or spacer 218 between head 212 and locking mechanism 222.

As previously stated, shipping spacer assembly 200 includes spacer 218. Spacer 218 is sized to fix a distance WP between wash tub 124 and rear panel 114. As shown in FIG. 3, spacer 218 extends between wash tub 124 and to rear panel 114. Spacer 218 may connect to wash tub 124 and rear panel 114. In other words, spacer 218 may be physically touching wash tub 124 and rear panel 114 during attachment of shipping spacer assembly 200 to wash tub 124.

In some embodiments, spacer 218 defines a bolt cavity 220. Bolt cavity 220 extends along axial direction A. Bolt cavity 220 removably receives shaft 214 of bolt 210. Generally, bolt cavity 220 is sized to fit shaft 214 of bolt 210, bolt cavity 220 defined as a space with a diameter CD smaller than diameter HD of head 212. Thus, during use or when shipping spacer assembly 200 is attached to washing machine appliance 100, spacer 218 is irremovable from shaft 214. In other words, bolt 210 is removable from spacer 218 and bolt cavity 220 by moving spacer 218 towards threaded portion 244 and restrained on shaft 214 by moving spacer 218 towards head 212. In some embodiments, spacer 218 is located along shaft 214 between head 212 and lock-receiving feature 216 along shaft 214. In certain embodiments, spacer 218 is further located between cord retention mechanism 224 and lock-receiving feature 216 along the shaft 214. Spacer 218 is generally located between head 212 and threaded portion 244.

Shipping spacer assembly 200 also includes locking mechanism 222. Generally, locking mechanism 222 removably engages bolt 210 at lock-receiving feature 216 to secure spacer 218 to the bolt 210. As shown in FIGS. 5 and 6, locking mechanism 222 may be a clip engaging a groove (e.g., lock-receiving feature 216). Locking mechanism 222 as a clip may surround at least a majority of a circumference at lock-receiving feature 216. Examples of locking mechanism 222 include a locking clip or a locking ring, including a circlip, a c-clip, a plastic clip, a ring, a metal clip, a snap clip, a plastic ring, a metal ring, a composite ring, or equivalents. Locking mechanism 222 may lock onto shaft 214 at lock-receiving feature 216 and may be removable from shaft 214.

Figure 10:
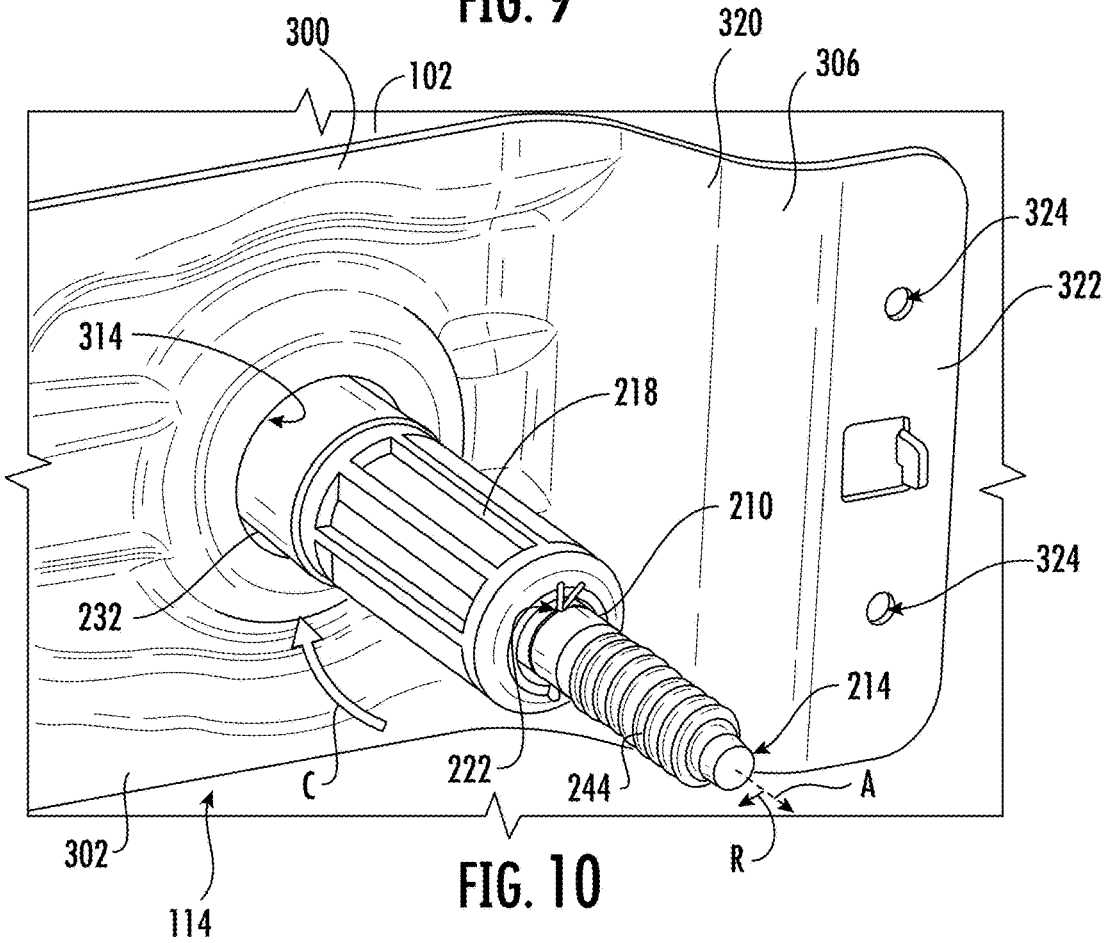
FIG. 10 provides an alternate perspective view of a portion of an exemplary shipping spacer assembly and a portion of an exemplary structural shipping bracket according to one or more exemplary embodiments of the present subject matter.

As shown in FIG. 10, locking mechanism 222 may be a pin engaging a hole (e.g., lock-receiving feature 216). Locking mechanism 222 may be received through lock-receiving feature 216, extending therethrough. Examples of locking mechanism 222 as a pin include a locking pin or a retaining cable. A locking pin may include or be provided as a straight pin, a cotter pin, a split pin, a parallel pin, a spring pin, a groove pin, a ball lock pin, a socket pin, a clamping pin, or an equivalent structure extending through shaft 214 at lock-receiving feature 216 to lock elements on the shaft 214 between the head 212 and the locking mechanism 222.

In some embodiments, locking mechanism 222 and lock-receiving feature 216 are located before the threaded portion 244 of shaft 214. Locking mechanism 222 locks spacer 218 and cord retention mechanism 224 along shaft 214. Spacer 218 and cord retention mechanism 224 are located along shaft 214 between locking mechanism 222 and head 212. During use, locking mechanism 222 locks spacer 218 or cord retention mechanism 224 along shaft 214. Thus, shipping spacer assembly 200 may be removed or attached to cabinet 102 as an attached assembly, the spacer 218 or cord retention mechanism 224 remaining attached on the shipping spacer assembly 200 during removal of shipping spacer assembly 200 from washing machine appliance 100. Advantageously, removal of shipping spacer assembly 200 from an appliance (e.g., with spacer 218 or cord retention mechanism 224 staying locked or remaining attached to shaft 214) may allow the spacer 218 to be removed with the bolt 210. Embodiments may reduce or eliminate the instance of spacers 218 being left in an appliance following installation of the appliance after transportation.

Generally, cord retention mechanism 224 is located along shaft 214 of bolt 210. Cord retention mechanism 224 includes a connecting tab 236 defining a shaft aperture 228 and a cord retention clip 238. As shown in FIGS. 7 and 8, cord retention clip 238 extends from connecting tab 236. Thus, connecting tab 236 removably receives shaft 214 at shaft aperture 228. In this regard, cord retention clip 238 extends adjacent to shaft 214 and is configured to receive a portion of power cord 170. Cord retention clip 238 receives a portion of power cord 170, holding power cord 170 against rear panel 114. In some embodiments, connecting tab 236 may be a two piece tab, with cord retention clip 238 connecting each piece of the two piece tab. The power cord 170 may be in clip 238, sandwiched between each piece of the two piece tab, encasing a portion of power cord 170. In some embodiments, cord retention mechanism 224 may be made of metal or another material difficult to cut. In this manner, a user attempting to remove the power cord 170 would be encouraged to remove the shipping spacer assembly 200 instead of attempting to cut the cord retention clip 238. Advantageously, removal of the power cord 170 by removal of the shipping spacer assembly 200 may avoid or decrease the instance of bolts or spacers being left in the appliance during use.

Advantageously, power cord 170 is contained in cord retention clip 238 during transportation. Further, power cord 170 must be removed from cord retention clip 238 to connect power cord 170 to the external power source. Advantageously, requiring removal of the shipping spacer assembly 200 in order to use power cord 170 of appliance may lead to removal of shipping spacer assembly 200, including spacer 218, prior to use of the appliance, which, in turn, may lead to a reduction of service calls, or improper leaving of shipping spacer assembly 200 or spacer 218 within the appliance (e.g., washing machine appliance 100) during use. Additionally or alternatively, suspension system 129 may be able to perform its function during use following removal of shipping spacer assembly 200 and may be preserved during transportation by using shipping spacer assembly 200 during transport.

Grommet 232 of shipping spacer assembly 200 may define a grommet cavity 234. Grommet 232 is located along shaft 214 between head 212 and spacer 218. Shaft 214 is removably received through grommet cavity 234. Additionally or alternatively, grommet 232 may be located along shaft 214 between head 212 and threaded portion 244. In some embodiments, grommet 232 touches head 212. Grommet 232 may be attached to spacer 218. Such may include or be provided as a unitary feature. In some embodiments, and as shown in FIG. 8, grommet cavity 234 may receive a portion of spacer 218 as well as shaft 214. Spacer 218 may extend from grommet 232 rear panel 114 at spacer hole 202 or opening (e.g., the first opening or the second opening) of the structural shipping bracket 300. As shown installed in FIG. 8, at least a portion of grommet 232 may be external to rear panel 114 when shipping spacer assembly 200 is attached to wash tub 124. In some embodiments, grommet 232 is affixed to spacer 218. Advantageously, grommet 232 affixed to spacer 218 may promote removal of shipping spacer assembly 200 as grommet 232 visibly needs to be removed in order to access cord retention mechanism 224 or power cord 170, indicating to the person installing the appliance that the bolt 210 needs to be removed, and spacer 218 is attached to grommet 232, so it will be removed with grommet 232.

Generally, shipping spacer assembly 200 is configured for receipt of power cord 170. Power cord 170 may be removable from shipping spacer assembly 200 only upon removal of cord retention mechanism 224, spacer 218, and locking mechanism 222 from shaft 214 of bolt 210. Additionally or alternatively, bolt 210 may be removed from wash tub 124 and rear panel 114 in order to remove power cord 170. Fully assembled, shipping spacer assembly 200 may have cord retention mechanism 224 next to head 212 and grommet 232. Grommet 232 may be next to cord retention mechanism 224 and spacer 218. Spacer 218 may be next to grommet 232 and locking mechanism 222. Locking mechanism 222 may be next to spacer 218 and threaded portion 244. In some embodiments, threaded portion 244 is received in bolt boss 204.

As shown in FIG. 8, head 212, grommet 232 and cord retention mechanism 224 of bolt 210 are located external to rear panel 114. Additionally or alternatively, head 212, grommet 232 and cord retention mechanism 224 of bolt 210 are located external to rear panel 114. As shown in FIGS. 8 and 10, spacer 218 and thread portion of bolt 210 are located internal to washing machine appliance 100, spacer 218 fixing distance WP between rear panel 114 and wash tub 124.

In some embodiments, washing machine appliance 100 may include at least two shipping spacer assemblies 200. Each shipping spacer assembly 200 may be removably attached to rear panel 114. Rear panel 114 may define at least two spacer holes 202. In certain embodiments, washing machine appliance 100 may comprise four shipping spacer 218 assemblies with rear panel 114 defining four spacer holes 202 (e.g., FIG. 6). There may be a corresponding number of spacer holes 202 to shipping spacer assemblies 200. Each shipping spacer assembly 200 of washing machine appliance 100 may be removably attach to rear panel 114 at each respective spacer hole 202. A portion of each shipping spacer assembly 200 may be located between rear panel 114 and wash tub 124, as shown in FIG. 3.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a cabinet comprising a rear panel, the rear panel comprising an outer face and an inner face;

a sub washer provided within the cabinet;

a structural shipping bracket comprising a main body and a mount, the main body defining an opening therethrough, the mount being extended from the main body, the structural shipping bracket being affixed to the inner face of the rear panel at the mount;

one or more permanent fasteners, wherein the one or more permanent fasteners are disposed within one or more preformed fastener points defined through the mount; and a shipping bolt removably disposed within the opening of the structural shipping bracket.

2. The washing machine appliance of claim 1, wherein the main body extends between a first end and a second end, wherein the mount is a first mount extended from the first end, and wherein the mount further comprises a second mount extended from the second end.

3. The washing machine appliance of claim 2, wherein the opening is a first opening positioned proximate the first end of the main body, and wherein the main body further defines a second opening positioned proximate the second end of the main body.

4. The washing machine appliance of claim 1, wherein the mount of the structural shipping bracket is permanently affixed to the inner face of the rear panel.

5. The washing machine appliance of claim 1, wherein the opening defines a circular cross-sectional area.

6. The washing machine appliance of claim 1, wherein the opening defines a U-shaped cross-sectional area.

7. The washing machine appliance of claim 1, wherein the sub washer comprises a bolt boss extending into the sub washer, and wherein the shipping bolt is received within the bolt boss.

8. The washing machine appliance of claim 1, wherein the structural shipping bracket is a first structural shipping bracket, wherein the washing machine appliance further comprises a second structural shipping bracket, wherein the first structural shipping bracket is affixed to a top portion of the rear panel, and wherein the second structural shipping bracket is affixed to a bottom portion of the rear panel.

9. The washing machine appliance of claim 1, wherein the structural shipping bracket is positioned between the rear panel and a rear wall of the sub washer.

10. The washing machine appliance of claim 1, wherein the cabinet further comprises a first side panel and a second side panel, and wherein the rear panel is removably connected to the first side panel and the second side panel.

11. The washing machine appliance of claim 1, wherein the shipping bolt includes a bolt body, a threaded portion, and a connecting portion, and wherein the connecting portion connects the bolt body to the threaded portion.

12. A washing machine appliance defining a vertical direction, a lateral direction, and a transverse direction, the washing machine appliance comprising:

a cabinet comprising a rear panel, a front panel, a first side panel, and a second side panel, the front panel and the rear panel being spaced apart along the transverse direction, the first side panel and the second side panel being spaced apart along the lateral direction, the rear panel comprising an outer face and an inner face, the outer face and the inner face being spaced apart along the transverse direction;

a sub washer provided within the cabinet, the sub washer comprising at least a wash tub, a wash basket, and a motor;

a structural shipping bracket comprising a main body, a first mount, and a second mount, the main body extending between a first end and a second end along the lateral direction, the main body defining a first opening and a second opening therethrough, the first mount being extended from the main body at the first end of the main body, the second mount being extending from the main body at the second end of the main body, the structural shipping bracket being permanently affixed to the inner face of the rear panel at the first mount and the second mount, wherein the first mount comprises a first portion and a second portion, wherein the first portion of the first mount is extended from the first end of the main body along the transverse direction, wherein the second portion of the first mount is extended from a distal end of the first portion along the lateral direction, wherein the second mount comprises a first portion and a second portion, wherein the first portion of the second mount is extended from the second end of the main body along the transverse direction, wherein the second portion of the second mount is extended from a distal end of the first portion along the lateral direction, wherein the first mount is permanently fastened to the inner face of the rear panel at the first portion of the first mount, wherein the second mount is permanently fastened to the inner face of the rear panel at the first portion of the second mount, and wherein the first portion of the first mount and the first portion of the second mount each define one or more preformed fastener points therethrough;

one or more permanent fasteners, wherein the one or more permanent fasteners are disposed within the one or more preformed fasteners points defined through the first portion of the first mount and the first portion of the second mount; and a shipping spacer assembly being removably disposed within the first opening and the second opening of the structural shipping bracket.

13. The washing machine appliance of claim 12, wherein the first opening is positioned proximate the first end of the main body, and wherein the second opening is positioned proximate the second end of the main body.

14. The washing machine appliance of claim 12, wherein the first opening and the second opening each define a circular cross-sectional area.

15. The washing machine appliance of claim 12, wherein the first opening and the second opening each define an U-shaped cross-sectional area.

16. The washing machine appliance of claim 12, wherein the wash tub defines a bolt boss extending into the wash tub, and wherein the shipping spacer assembly is received within the bolt boss.

17. The washing machine appliance of claim 12, wherein the structural shipping bracket is a first structural shipping bracket, wherein the washing machine appliance further comprises a second structural shipping bracket permanently affixed to the inner face of the rear panel, and wherein the first structural shipping bracket is positioned above the second structural shipping bracket along the vertical direction.

* * * * *